US005222806A

United States Patent [19]

Roberts, III

[11] Patent Number: 5,222,806

[45] Date of Patent: Jun. 29, 1993

[54] LAMP

[75] Inventor: Rockwood T. Roberts, III, Midland Park, N.J.

[73] Assignee: C. N. Burman Co., Paterson, N.J.

[21] Appl. No.: 893,835

[22] Filed: Jun. 4, 1992

[51] Int. Cl.[5] ..... F21S 1/12

[52] U.S. Cl. ..... 362/401; 362/427; 362/287; 248/122; 248/291

[58] Field of Search ..... 362/427, 401, 403, 287, 362/413, 416, 417, 418; 248/397, 398, 407, 122, 291

[56] References Cited

U.S. PATENT DOCUMENTS 3,790,773 2/1974 Sapper ..... 362/401
4,847,740 7/1989 Laske ..... 362/427
4,974,135 11/1990 Wen-tsung ..... 362/413
4,974,139 11/1990 Chin-Song ..... 362/413
4,975,815 12/1990 Lin ..... 362/427
5,050,054 9/1991 Hsu ..... 362/287

*Primary Examiner*—Ira S. Lazarus
*Assistant Examiner*—L. Heyman
*Attorney, Agent, or Firm*—Kirschstein, Ottinger, Israel & Schiffmiller

[57] ABSTRACT

An adjustable desk lamp includes a pair of pivot arms mounted on a stepped base, and a movable support mounted on and along the pivot arms to a rest position in which the support rests on a selected step of the base to support a lamp head and a bulb contained therein at a selected elevation and orientation.

13 Claims, 5 Drawing Sheets

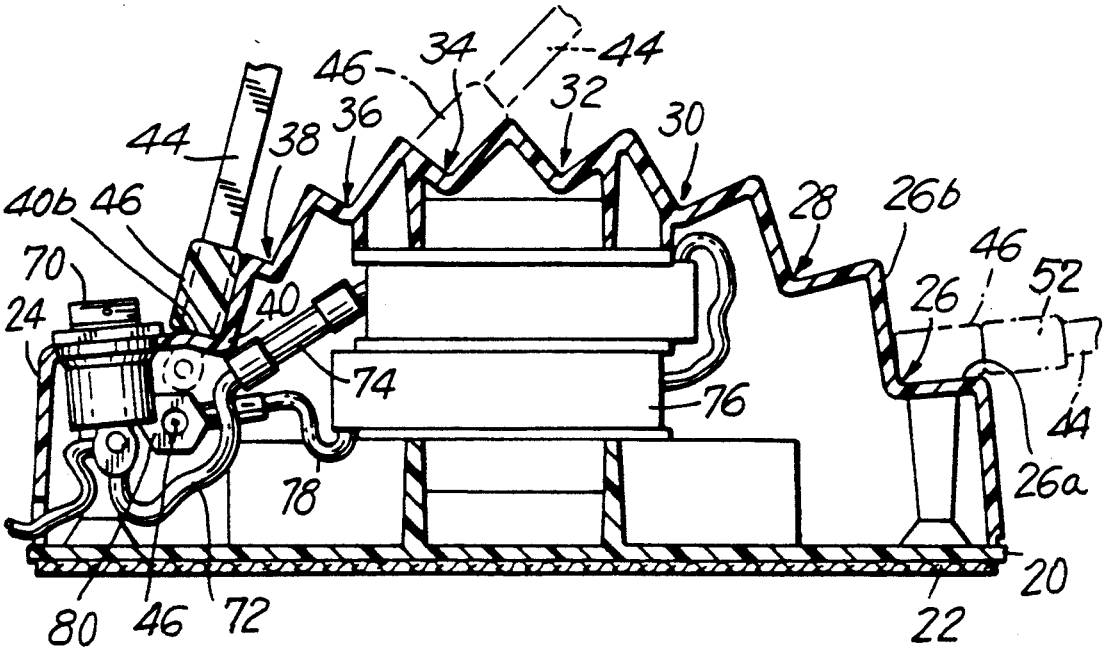
FIG. 3
FIG. 5
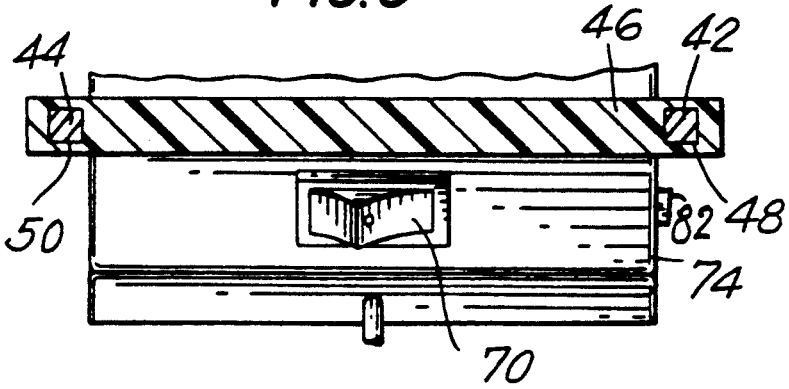

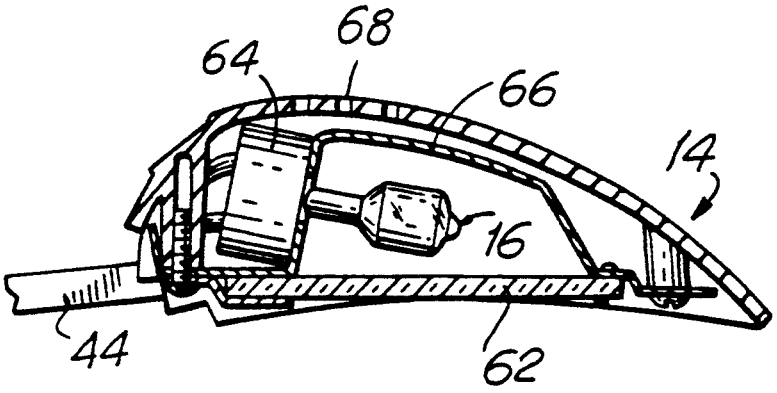
FIG. 4
FIG. 6
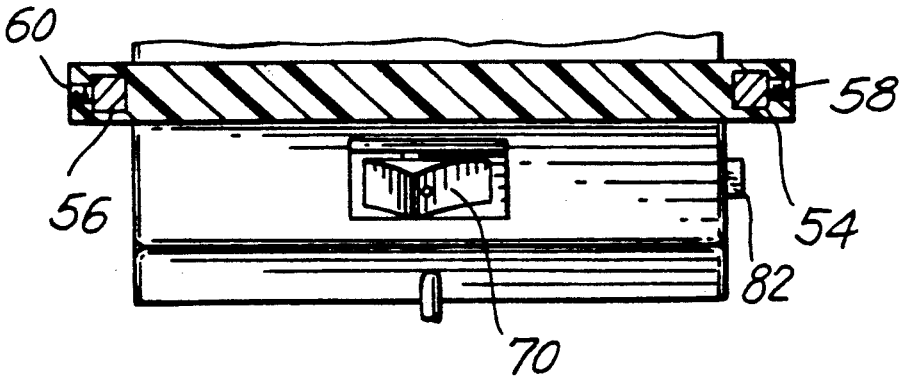

FIG. 8
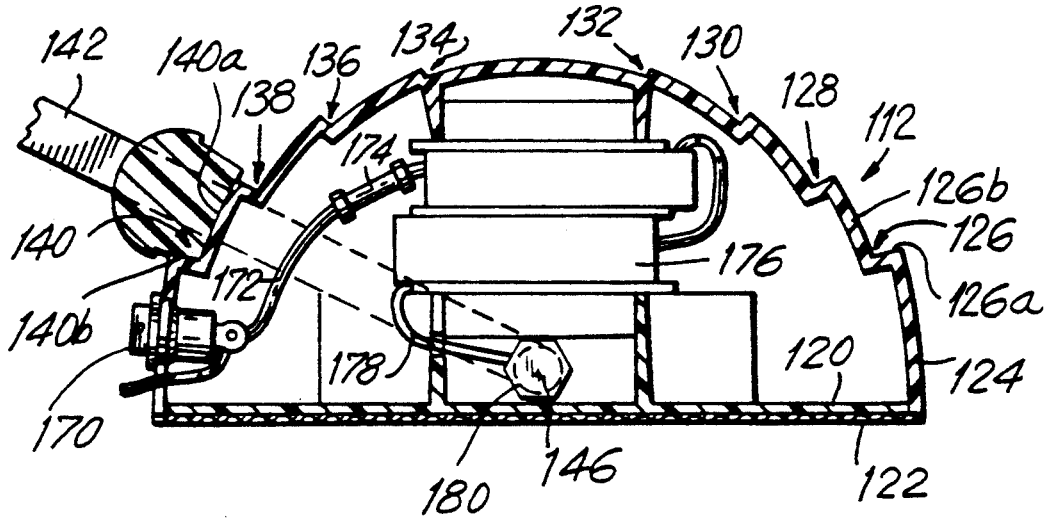
FIG. 9
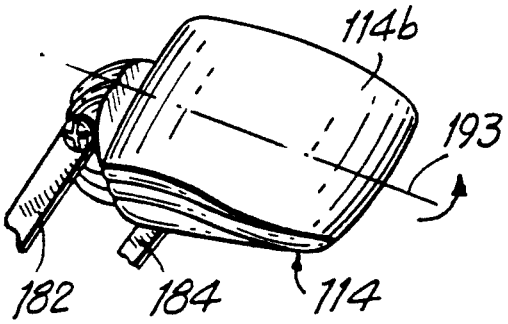
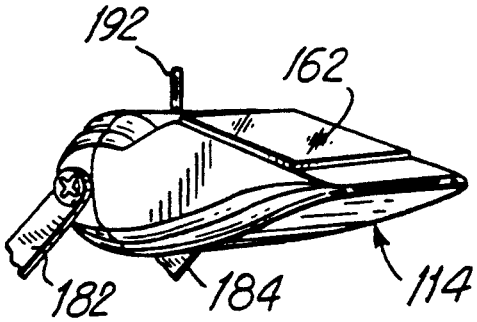
FIG. 10
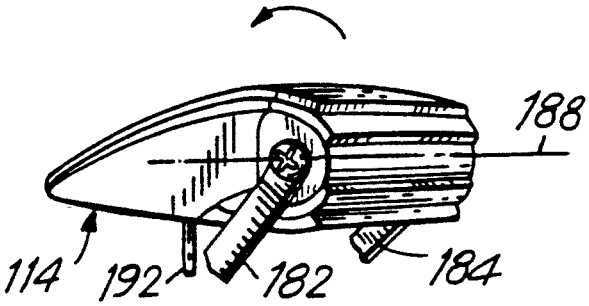
FIG. 11

LAMP

BACKGROUND OF THE INVENTION

1. Field of the Invention

This invention generally relates to a lamp and, more particularly, to a desk lamp readily adjustable to direct light in many different directions.

2. Description of Related Art

There are many different types of adjustable desk lamps. In a so-called "gooseneck" version, a lamp head is adjustably supported relative to a base supported on a desk top by a semi-rigid, bendable conduit through which electrical wires run to supply electricity to a bulb in the head. Counterweighted lamps, in which a counterweight is mounted at one end of a lever arm to balance a lamp head located at an opposite end of the lever arm, are also known. Although generally satisfactory for their intended purpose, the need persists for an attractive lamp capable of being readily adjusted to direct light in many different directions.

SUMMARY OF THE INVENTION

1. Objects of the Invention

It is a general object of this invention to provide a readily adjustable lamp.

It is another object of this invention to provide an adjustable lamp which is durable in construction, inexpensive to manufacture, and simple to use.

2. Features of the Invention

In keeping with these objects, and others which will become apparent hereinafter, one feature of this invention resides, briefly stated, in a lamp comprising a base having a bottom wall, and a plurality of steps above the bottom wall. An electric bulb, preferably a halogen bulb, is contained in a head which is adjustably supported by adjustment means at variable elevations and inclinations relative to the bottom wall. The adjustment means includes an elongated pivot arm mounted on the base for pivoting movement about a pivot axis, and a movable support mounted for movement on and along the pivot arm to a rest position in which the movable support rests on a selected one of the steps to support the head at a selected one of the elevations.

In a preferred embodiment of a desk lamp, two pivot arms in mutual parallelism are mounted for joint movement on the base. The movable support spans both arms, and is movable toward and away from a stationary support fixedly mounted approximately midway along the length of the pivot arms. A user slides the movable support lengthwise along the pivot arms to a desired position in order to rest the movable support on one of the steps.

In this embodiment, the steps include generally planar support surfaces inclined at different angles of inclination relative to the bottom wall which lies in a generally horizontal plane. The steps are successively arranged in a row, and the angles of inclination increase in slope along the row. Advantageously, the steps incrementally increase in slope by 10° for each step. The steps have support surfaces that lie at different radial distances from the pivot axis.

In a second preferred embodiment of a desk lamp, a counterweight is mounted between respective ends of a pair of generally parallel lever arms in order to balance a lamp head pivotably mounted between respective opposite ends of the lever arms. The lever arms are, in turn, pivotably mounted about a fulcrum axis on the pivot arms.

As before, the steps include support surfaces, but, in this embodiment, the support surfaces extend radially of, and are arranged symmetrically about, the pivot axis.

Advantageously, the pivot arms are axially spaced apart by a predetermined distance, and the counterweight has an axial length shorter than said predetermined distance to permit the counterweight to fit through, and be moved past, the pivot arms. This allows the lamp head and the counterweight to be swung from side to side, and to be adjusted in elevation due to the symmetrical arrangement of the steps. In addition, the lamp head is rotatably mounted about a transverse axis to permit light emitted from the bulb within the head to be directed downwardly no matter which side of the base that the head is positioned. A handle may extend from the head to facilitate movement thereof.

As previously mentioned, the bulb is preferably a halogen bulb requiring low voltage, e.g. 12 volts AC. Hence, a transformer is advantageously mounted within the base to reduce the 120 volt AC supply voltage to this low voltage. The low voltage is conducted from the transformer along the pivot arms and/or the lever arms, which are advantageously constituted of an electrically conductive material, to the bulb within the head. The low voltage does not constitute a safety hazard.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 3 is an enlarged, sectional view taken on line 3—3 of FIG. 1, and shows different positions of the movable support and the lever arms in phantom;

FIG. 4 is a broken-away, enlarged view taken on line 4—4 of FIG. 1;

FIG. 5 is an enlarged, sectional view taken on line 5—5 of FIG. 1;

FIG. 6 is an enlarged, sectional view taken on line 6—6 of FIG. 1;

FIG. 8 is an enlarged, sectional view taken on line 8—8 of FIG. 7;

FIG. 9 is a broken-away, isolated view of the lamp head during an initial stage of its rotation;

FIG. 10 is a view analogous to FIG. 9, but at a subsequent stage of its rotation; and FIG. 11 is a view analogous to FIG. 9 showing the lamp head turned around from its orientation in FIG. 9.

DETAILED DESCRIPTION OF THE PREFERRED EMBODIMENTS

Figure 1:
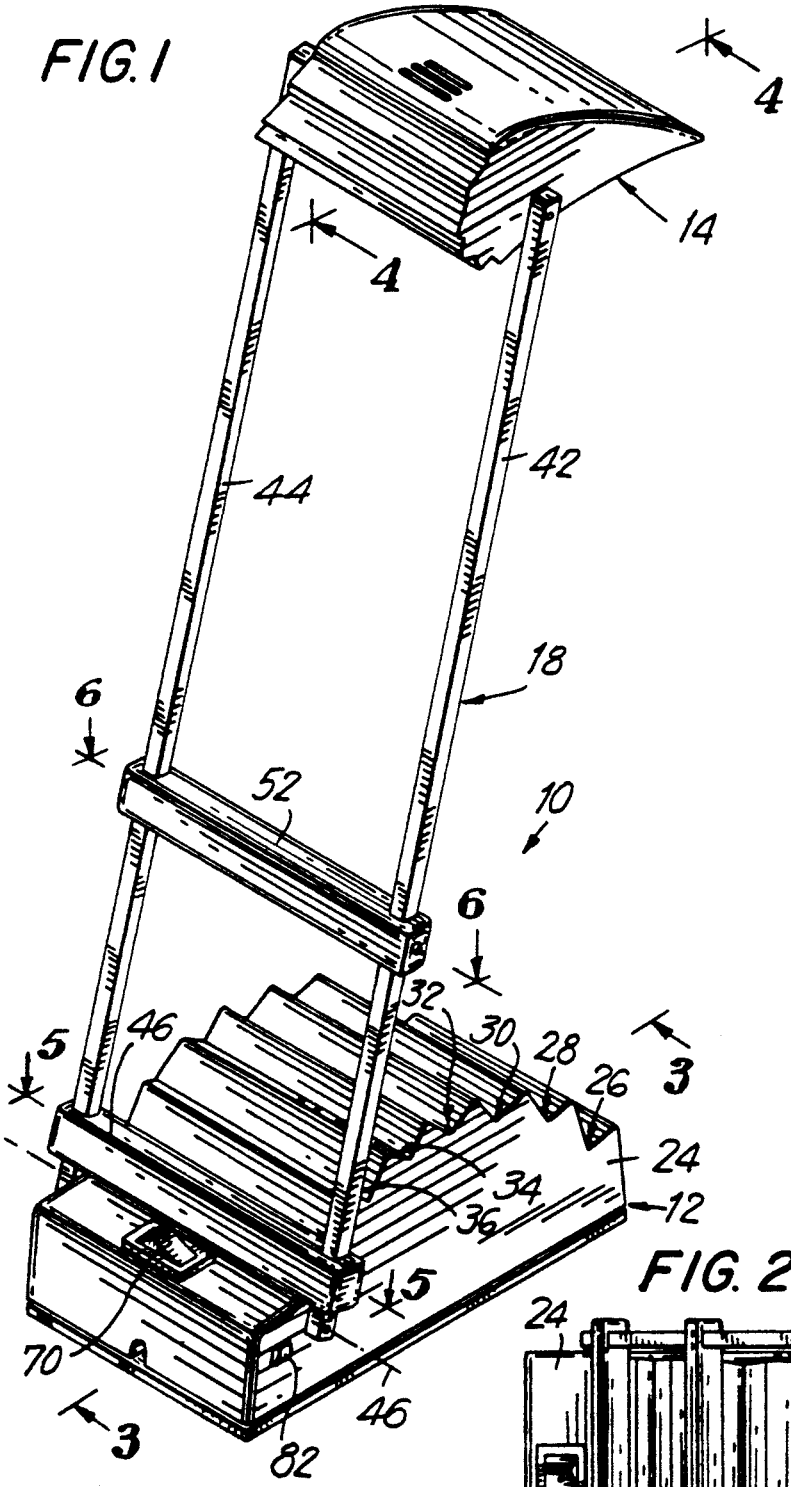
FIG. 1 is a perspective view of a first embodiment of a desk lamp according to this invention.
Figure 2:
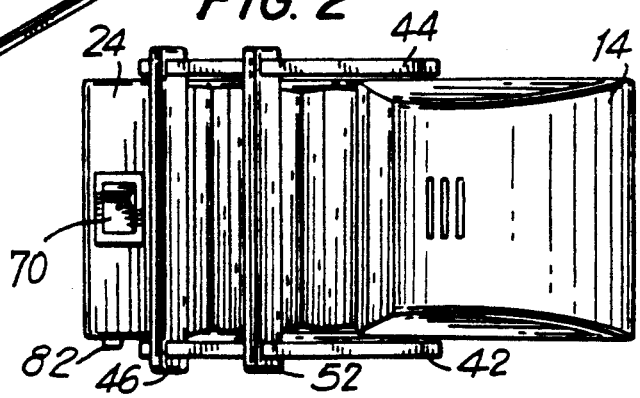
FIG. 2 is a top plan view thereof.

Referring now to the drawings, reference numeral 10 generally identifies a lamp having a base 12 for supporting the lamp on a support surface, e.g. a desk top, a floor, or any analogous support; a lamp head 14 in which an electric bulb 16 (see FIG. 4) is housed; and adjustment means 18 for adjustably supporting the head 14 at variable elevations and inclinations relative to the support surface.

As best shown in FIG. 3, base 12 includes a generally planar bottom wall 20 covered with a layer of felt 22, and a stepped housing 24 mounted on the bottom wall 20. Housing 24 includes a plurality of steps and, in the illustrated preferred embodiment, eight steps are arranged successively in a row and are numbered 26, 28, 30, 32, 34, 36, 38 and 40. Each step has a pair of generally planar inclined surfaces generally arranged at right angles to each other. Thus, representative first step 26 has a so-called "tread" portion 26*a* and a so-called "riser" portion 26*b*, and representative last step 40 has a tread portion 40*a* and a riser portion 40*b*. Tread portion 26*a* is inclined at an angle of inclination of 10° relative to the horizontal plane of the bottom wall 20. Each successive thread portion has an inclination angle that increases by 10° increments. Hence, treads 26, 28, 30, 32, 34, 36, 38 and 40 have inclination angles of 10°, 20°, 30°, 40°, 50°, 60°, 70° and 80°, respectively.

The adjustment means includes a pair of mutually parallel elongated pivot arms 42, 44 mounted at opposite sides of the housing 24 for joint movement about a pivot axis 46. Each pivot arm is preferably constituted of an electrically conductive material, e.g. a solid metal rod of square-shaped cross-section.

A movable support 46 spans, and extends past, the pivot arms 42, 44, and is mounted for joint movement on and along the latter. The movable support 46 has, as best shown in FIG. 5, square-shaped mounting holes 48, 50 through which the pivot arms 42, 44 slide with frictional engagement.

A stationary support 52 also spans, and extends past, the pivot arms 42, 44 about midway along the lengths of the pivot arms. As best shown in FIG. 6, the stationary support 52 has a pair of mounting holes 54, 56 through which the pivot arms 42, 44 extend. However, set screws 58, 60 fixedly secure the stationary support 52 to the pivot arms 42, 44.

The lamp head 14 is pivotably mounted between the pivot arms 42, 44 at their ends remote from the housing 24. As best shown in FIG. 4, head 14 includes a light-transmissive shield 62 in the path of the emitted light, and a socket 64 into which the bulb 16 is mounted. Bulb 16 is a halogen bulb operable at 20 W 12 volts AC. A metal reflector element 66 is located rearwardly of the bulb 16, and vent holes 68 are provided in a casing to allow hot air to escape from the head.

An electrical switch 70 is mounted on the housing 24 and, as best shown in FIG. 3, the switch 70 is operative to convey 120 volts AC voltage along supply wire 72 through a fuse 74 to a transformer 76 operative for reducing the high input voltage to a low, e.g. 12 volts AC, voltage. The low voltage is thereupon conducted along wire 78 to a pair of conductive lugs 80 which are in electrical contact with the pivot arms. The pivot arms 42, 44 conduct this low voltage to the socket 64 to energize the bulb 16. The low voltage is insufficient to constitute a safety hazard and, of course, the movable support 46, the stationary support 52, and the casing for the head 14 are all constituted of an electrically non-conductive material, e.g. synthetic plastic, in order to prevent the arms 42, 44 from being electrically shorted.

In use, a user merely grasps opposite ends of the movable support 46 and moves the same toward or away from the stationary support 52 to a desired rest position. This rest position corresponds to one of the steps so that the movable support will rest on the selected step in order to support the pivot arms 42, 44 and the head 14 in a selected orientation and elevation. As shown in phantom lines in FIG. 3, the movable support 46 is shown as being capable of resting on steps 34 and 26. The head 14 is also pivotable about a head axis extending parallel to the pivot axis 46.

Thus, the head 14 can be supported by resting the movable support 46 at any one of the steps on the housing 24. In order to prevent the head 14 from swinging over the switch 70 and falling onto a counter top, thereby possibly doing damage to the bulb therein, a stop 82 projects from a side of the housing 24 to prevent the pivot arm from moving past the stop. The stop 82 engages pivot arm 42 in an upright position, i.e. when arm 42 is oriented at 90° relative to the horizontal plane of the bottom wall 20.

Turning now to the counterweighted desk lamp depicted in FIGS. 7–11, like parts with those of the first embodiment have been numbered with the same reference numerals increased by 100.

Thus, lamp 110 includes a base 112, a lamp head 114, and adjustment means 118 for adjustably supporting the head 114 at variable elevations and inclinations relative to a desk top. As best shown in FIG. 8, base 112 includes a generally planar bottom wall 120 covered with a layer of felt 122, and a stepped housing 124 mounted on the bottom wall 120. Housing 124 includes a plurality of steps and, as illustrated, eight steps are symmetrically arranged about a central pivot axis 146. In a preferred embodiment, there are eight steps numbered 126, 128, 130, 132, 134, 136, 138 and 140. Each step has a pair of tread and riser portions generally at right angles to each other. Thus, representative first and last steps 126, 140 have tread portions 126*a*, 140*a*, and riser portions 126*b*, 140*b*, respectively. The tread portions extend radially of the pivot axis 146, and are successively arranged along incrementally increasing angles of inclination relative to the generally horizontal plane in which the bottom wall 120 lies. The riser portions extend along curved arcs whose center of curvature lies on the pivot axis 146. The riser portions are arranged at different radial distances from the pivot axis 146.

The adjustment means 118 includes a pair of mutually parallel elongated pivot arms 142, 144 mounted at opposite sides of the housing 124 for joint movement about the pivot axis 146. Each pivot arm 142, 144 is preferably constituted of an electrically conductive material, e.g. a solid metal rod of rectangular cross-section, preferably a stamped link.

A movable support 147 spans, and extends past, the pivot arms 142, 144, and is mounted for joint movement on and along the latter. The movable support has rectangular-shaped mounting holes through which the pivot arms 142, 144 slide with frictional engagement. A stationary support 152 also spans, and extends past, the pivot arms at the far ends thereof.

Figure 7:
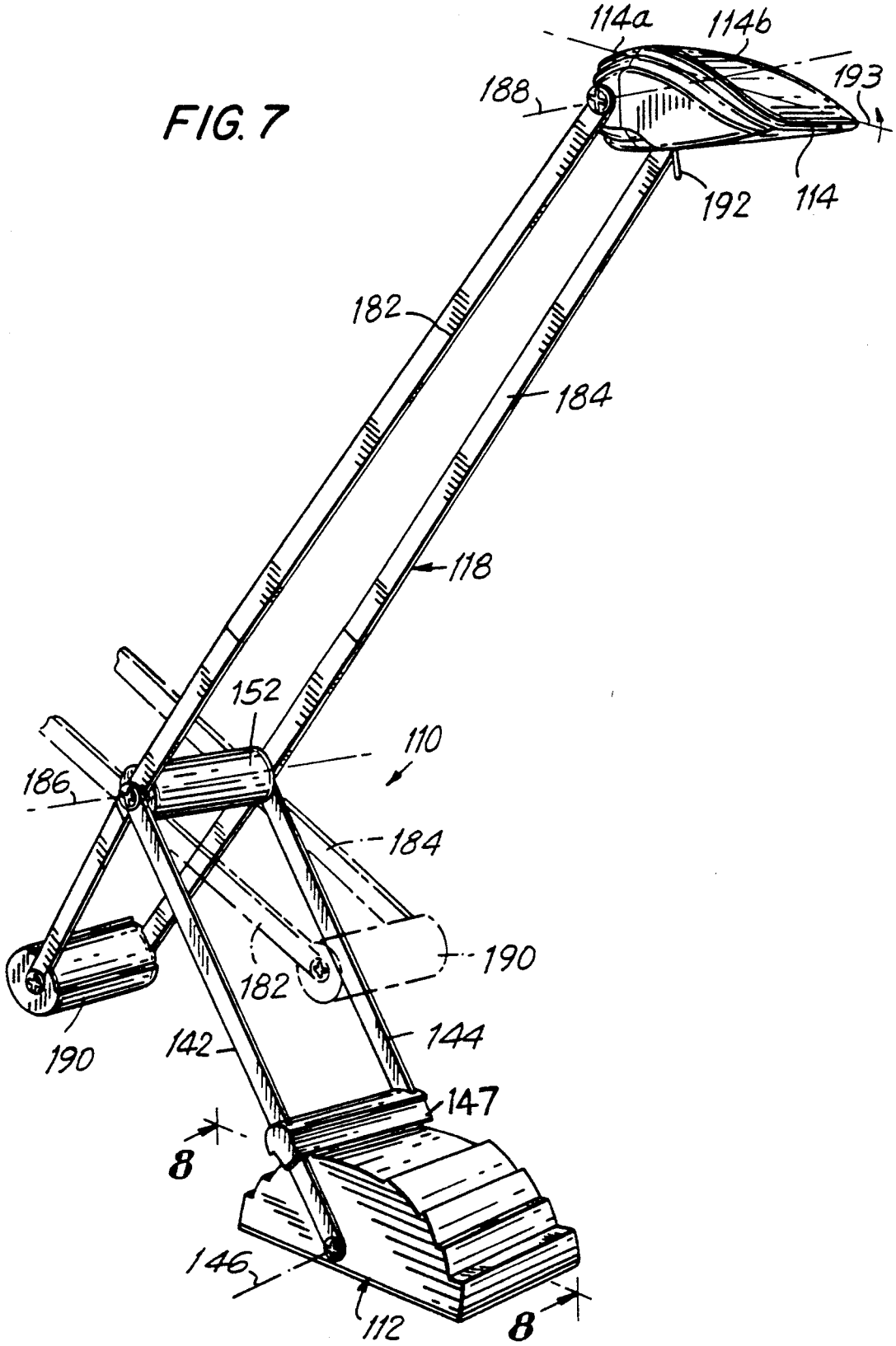
FIG. 7 is a perspective view of another embodiment of a counterweighted desk lamp according to this invention, and showing the counterweight moved to an adjusted position in phantom.

The adjustment means further includes a pair of elongated lever arms 182, 184 mounted to the far ends of the pivot arms 142, 144 for pivoting movement about a fulcrum axis 186. The lever arms have first lever ends pivotably connected to the head 114 to allow the head to be moved about a head axis 188 generally parallel to the fulcrum axis 186 and the pivot axis 146, and second lever ends connected to a counterweight 190. As shown in FIG. 7, the lengths of the lever arms between the fulcrum axis 186 and the counterweight 190 are less than the lengths of the lever arms between the fulcrum axis 186 and the head axis 188. The weight of the counterweight 190 is so selected as to counterbalance the weight of the head 114.

The counterweight 190 has an axial length shorter than the predetermined distance between the lever arms at the fulcrum axis 186. This permits the counterweight 190 to swing through the pivot arms 142, 144, as depicted in phantom lines in FIG. 7. For this purpose, the ends of the lever arms between the counterweight and the fulcrum axis 186 converge toward each other in a direction from the fulcrum axis 186 to the counterweight 190.

In use, the user need only grasp the movable support 147 to move the same toward and away from the stationary support 152 to a desired rest position in which the movable support rests on a selected one of the steps of the housing 124 to support the head 114 at a selected elevation and orientation. Thereupon, the user may pivot the head 114 about the head axis 188, or, if the user wishes, he or she may grasp a downwardly extending handle 192 to raise or lower the head by moving the same about the fulcrum axis 186. The counterweight 190 will balance the head in any selected position.

As best shown in FIG. 8, an electrical switch 170 is employed to switch 120 volts AC voltage entering the housing for conduction along wire 172 to a transformer 176 via a fuse 174. The output of transformer 176 is conducted along wire 178 to a pair of conductive lugs 180 which are in electrical communication with pivot arms 142, 144. As before, these arms are made of electrically conductive material to convey the low voltage output of the transformer therealong to the lever arms 182, 184 which also are constituted of electrically conductive material, to eventually deliver the low voltage to a halogen bulb located within the head 114.

In accordance with another feature of this invention, the head depicted in FIG. 7 can be swung to either side of the base 112. To this end, the head 114 is comprised of two casing portions. A first casing portion **114*a* is pivotably connected to the far ends of the lever arms 182, 184, and a second casing portion 114*b* is rotatable about a transverse central axis 193 that is generally perpendicular to the head axis 188. Thus, as shown in sequential views of FIGS. 9–11, the casing portion 114*b* is rotated about central axis 193 until a lower shield 162 faces upwardly, as depicted in FIG. 10. Thereupon, the head 114 is swung around axis 188 until the shield 162 again faces downwardly. Upon comparing the positions of the head 114 in FIGS. 7 and 11, it will be noted that the head has been turned around, i.e. has been changed from facing toward the right in FIG. 7, to facing toward the left in FIG. 11. The turning around of the head 114, together with the pivoting of the lever arms 182, 184 from their solid line to their phantom line positions depicted in FIG. 7**, completes the reversal of the position of the lamp head and, of course, any one of the steps on the housing is available to support the head at a selected elevation and orientation.

It will be understood that each of the elements described above, or two or more together, also may find a useful application in other types of constructions differing from the types described above.

While the invention has been illustrated and described as embodied in a lamp, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. A lamp comprising:

(a) a base having a bottom wall and a plurality of steps above the bottom wall;

(b) an electric bulb for emitting light;

(c) a head for holding the bulb; and (d) adjustment means for adjustably supporting the head at variable elevations relative to the bottom wall, including a pair of elongated pivot arms mounted in mutual parallelism on the base for pivoting movement about a pivot axis, a stationary support spanning, and fixedly mounted to, the arms, and a movable support spanning and mounted for movement on, and along, the pivot arms toward and away from the stationary support, to a rest position in which the movable support rests on a selected one of the steps to support the head at a selected one of the elevations.

2. The lamp according to claim 1, wherein the bottom wall lies in a generally horizontal plane, and wherein the steps include generally planar support surfaces inclined at different angeles of inclination relative to the horizontal plane.

3. The lamp according to claim 2, wherein the steps are successively arranged in a row, and wherein the angles of inclination increase in slope along the row.

4. The lamp according to claim 3, wherein a first one of the steps has an angle of inclination of 10°, and wherein the successive steps along the row increase in slope by 10° for each step.

5. The lamp according to claim 1, wherein the steps have support surfaces that lie at different radial distances from the pivot axis.

6. The lamp according to claim 1, wherein the head is pivotably mounted between both arms.

7. The lamp according to claim 1; and further comprising an electrical switch on the base to selectively supply a high supply voltage to the lamp, and a transformer within the base for reducing the supply voltage to a low voltage; and wherein the arms are constituted of an electrically-conductive material to conduct the low voltage to the bulb to cause the bulb to emit light.

8. The lamp according to claim 1; and further comprising a stop projecting from the base to prevent the pivot arms from pivoting past the stop.

9. The lamp according to claim 1, wherein the steps include support surfaces extending radially of, and arranged symmetrically about, the pivot axis.

10. The lamp according to claim 1, wherein the adjustment means includes a pair of elongated lever arms mounted to the pivot arms for pivoting movement about a fulcrum axis, said lever arms having first lever ends pivotably connected to the head to allow the head to be moved about a head axis parallel to the fulcrum axis, and second lever ends connected to a counterweight.

11. The lamp according to claim 10, wherein the pivot arms are axially spaced apart by a predetermined distance, and wherein the counterweight has an axial length shorter than said predetermined distance to permit the counterweight to fit through and be moved past the pivot arms.

12. The lamp according to claim 10, wherein the head has a first part, and a second part rotatably mounted relative to the first part about a transverse axis that is normal to the head axis, and wherein the bulb is contained within the second part.

13. The lamp according to claim 1, wherein the head includes a handle to move the head.

* * * * *